US007637071B2

(12) United States Patent
Pryor

(10) Patent No.: US 7,637,071 B2
(45) Date of Patent: Dec. 29, 2009

(54) MULTIPLE LEG CONCRETE ANCHOR

(76) Inventor: John Duncan Pryor, 4028-39th Ave., Oakland, CA (US) 94619

( * ) Notice: Subject to any disclaimer, the term of this patent is extended or adjusted under 35 U.S.C. 154(b) by 146 days.

(21) Appl. No.: 10/866,996

(22) Filed: Jun. 15, 2004

(65) Prior Publication Data

US 2005/0276674 A1 Dec. 15, 2005

(51) Int. Cl.
*E04B 1/38* (2006.01)
*E02D 27/32* (2006.01)

(52) U.S. Cl. ..... 52/698; 52/295; 52/296

(58) Field of Classification Search ..... 52/745.21, 52/295, 296, 739.1, 512, 698–715; 403/296, 403/286, 299, 167, 408.1, 231, 262, 403; 248/351, 346.5
See application file for complete search history.

(56) References Cited

U.S. PATENT DOCUMENTS 1,333,523 A * 3/1920 Williams, Jr. ..... 52/295
2,240,016 A * 4/1941 Pinney ..... 52/296
2,879,660 A * 3/1959 Reintjes ..... 52/509
3,349,531 A * 10/1967 Watson ..... 52/296
3,405,497 A * 10/1968 McNair ..... 52/699
3,837,752 A * 9/1974 Shewchuk ..... 403/2
4,007,564 A * 2/1977 Chisholm ..... 52/98
4,437,427 A * 3/1984 Mampaeij ..... 114/218
4,458,463 A * 7/1984 Behrend ..... 52/295
5,384,993 A * 1/1995 Phillips ..... 52/92.2
5,501,048 A * 3/1996 Nakanishi ..... 52/296
5,558,455 A * 9/1996 Emery ..... 403/2
5,644,885 A * 7/1997 Eischeid ..... 52/513
6,015,138 A * 1/2000 Kohlberger et al. ..... 256/65.14
6,155,019 A * 12/2000 Ashton et al. ..... 52/739.1
6,202,371 B1 * 3/2001 Natelli, Jr. ..... 52/296
6,519,830 B1 * 2/2003 Mehan ..... 29/525.01
6,868,641 B2 * 3/2005 Conner et al. ..... 52/98

OTHER PUBLICATIONS www.dictionary.com definition of "bolt".*

* cited by examiner

*Primary Examiner*—Brian E Glessner
*Assistant Examiner*—Adriana Figueroa
(74) *Attorney, Agent, or Firm*—IPxLaw Group LLP; Claude A. S. Hamrick

(57) ABSTRACT

An anchor having multiple legs for a concrete wall. The anchor has an interface plate with two sides. Disposed on a first side is a stud that is connectable to a bracket. Disposed on the second side of the interface plate are at least two legs. Each of the legs is insertable and secured to a respective hole formed in the concrete wall with epoxy. Once the epoxy cures, the leg attaches the anchor to the concrete wall.

5 Claims, 2 Drawing Sheets

MULTIPLE LEG CONCRETE ANCHOR

FIELD OF THE INVENTION

The present invention generally relates to wall anchors for concrete walls and more particularly to a wall anchor with multiple legs that are attachable to a concrete wall using an adhesive.

BACKGROUND OF THE INVENTION

Tilt-up building construction generally consists of concrete wall panels that are precast horizontally on the ground, cured, and then tilted up into place. The roof framing systems of these buildings generally consist of trusses, girders, beams, purlins, joists and stiffeners that can be incorporated into wall tie and diaphragm continuity systems.

In areas subject to high seismicity, the connection between the walls of older tilt-up buildings and their timber roof framing system is generally inadequate per the currently established seismic design standards. Accordingly, seismic upgrading of such structures is occurring in older tilt-up buildings in order to mitigate these inadequacies. Such upgrades typically consist of the retrofit installation of wall tie systems having many individual components attached to the concrete wall panels and the roof framing systems.

For example, a flare strut system, as explained in U.S. Pat. No. 6,493,998, can be used to transfer forces between a concrete wall panel and a roof diaphragm continuity element in a building's roof framing system as part of a seismic upgrade project. The flare strut system comprises a plurality of elongated strut elements that connect between the wall panel and a diaphragm continuity element. For the wall panel, an end connector assembly is attached to the wall. The end connector assembly is typically attached to the wall panel by drilling holes through the wall panel and passing a threaded bolt through an anchor plate located on the exterior side of the wall panel, the hole drilled through the wall panel, and the base plate of the end connector. A nut is then threaded onto the bolt from the interior of the building to secure the anchor plate, bolt and end connector to the building. The use of an exterior anchor plate may detract from the aesthetics of the building or may be very costly to install due to the removal and replacement work of the building's exterior finish. Furthermore, the installation of an end connector assembly with an exterior anchor plate may be impossible in certain situations (e.g., the presence of an adjacent building).

Alternatively, the end connector assembly can be attached to a concrete wall using an epoxy anchor if the wall has sufficient thickness. Specifically, a 1 in. diameter threaded rod is installed in a corresponding hole drilled in the concrete wall panel. The threaded rod is secured to the wall panel with epoxy adhesive and the end connector assembly is attached to the threaded rod with a nut. With this type of installation, an exterior plate anchor is not needed.

In order to provide the necessary strength for the flare strut system using an epoxy anchor, the threaded rod must be embedded into the concrete wall panel at least 5.75 inches, and typically 6.75 inches. Generally, these embedment depths will require that the thickness of the concrete wall panel be at least 7 to 8 inches thick. Because most concrete wall panels are typically 6 inches thick, the maximum anchor embedment depth is generally limited to 4.5 to 5 inches. Accordingly, because of the decreased anchor embedment depth, the capacity of an epoxy anchor is generally found to be insufficient.

Another problem with epoxy anchors is that when large diameter epoxy anchors are installed in shallow embedments, it is possible the concrete will fail before the anchor, and thus precipitate a brittle failure mode Brittle failure modes are undesirable and should be avoided whenever possible. Brittle epoxy anchor failure modes are avoided by providing a sufficient anchor embedment depth so as to precipitate a ductile failure of the threaded rod element of an epoxy anchor before the concrete experiences brittle failure. However, as previously explained above, it may not be possible to provide a sufficient embedment depth for the epoxy anchor due to the thickness limitations associated with tilt-up concrete wall panels.

SUMMARY OF THE INVENTION

In accordance with the present invention, there is provided an anchor having multiple legs for securing an end connector of a flare strut system, or other connection device, to a concrete wall. The anchor has an interface plate with a first side and a second side. Attached to the first side is a threaded stud which is receivable into the end connector and secured with a nut. Typically, the stud is perpendicular to and positioned in the center of the interface plate. The anchor further includes at least two legs attached on a second side of the interface plate opposite the first side. The legs are evenly spaced on the interface plate and project perpendicular to the second side of the interface plate. The legs are formed from threaded rod and engage threaded holes formed in the interface plate.

A series of holes are drilled in the concrete wall in order to attach the anchor thereto. The holes are drilled in the same pattern as the legs are attached to the interface plate. In this respect, each hole corresponds to a respective one of the legs on the interface plate. Furthermore, the diameter of each hole is formed slightly larger than the outer diameter of each leg.

In order to attach the anchor to the concrete wall, epoxy is injected into each hole. Then, the legs are inserted into corresponding holes formed in the concrete wall. Once the epoxy has cured, then the anchor is securely attached to the wall and the end connector of the flare strut system can be attached to the stud.

BRIEF DESCRIPTION OF THE DRAWING FIGURES

These, as well as other features of the present invention, will become more apparent upon reference to the drawings wherein.

DETAILED DESCRIPTION OF THE INVENTION

Figure 1:
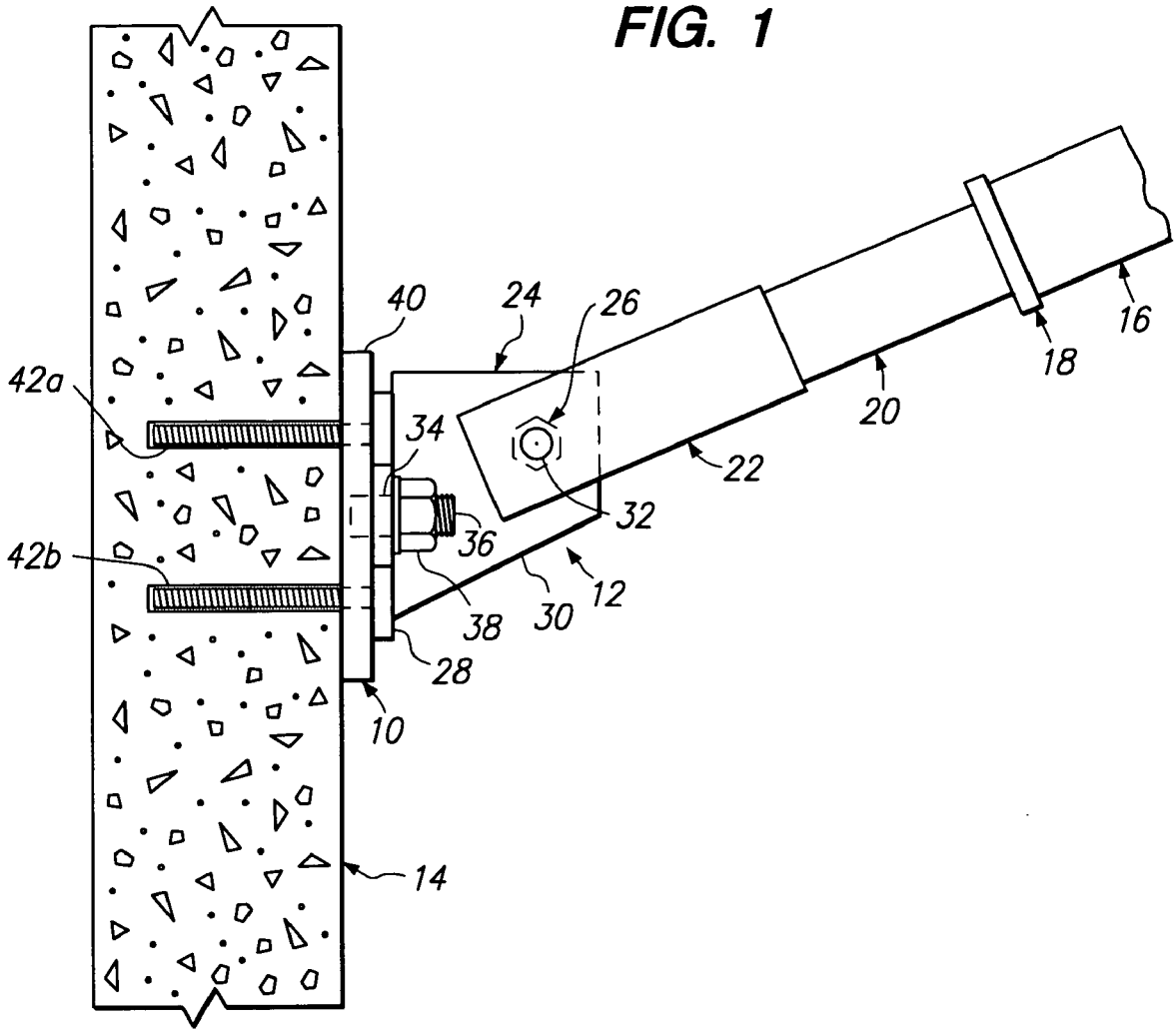
FIG. 1 is a cross-sectional view of an installed wall anchor with flare strut.

Referring now to the drawings wherein the showings are for purposes of illustrating a preferred embodiment of the present invention only, and not for purposes of limiting the same, FIG. 1 illustrates an installed wall anchor 10 attaching a flare strut system 12 to a concrete wall panel 14. The flare strut system 12 has a strut element 16, an interface plate 18, a pipe element 20, and a coupler element 22. The details of the flare strut system 12 can be found in Applicant's issued U.S. patent entitled "Flare Strut System" (U.S. Pat. No. 6,493, 998), the contents of which are incorporated herein by reference. Typically, the coupler element 22 attaches to an end connector 24 through the use of a connection bolt or pin 26. The end connector 24 has a base plate 28 and two connection plates 30 welded thereto. The two connection plates 30 are welded perpendicular to the base plate 28 and parallel to each other such that each connection plate 30 has a matching hole 32 formed therein for receiving the connection bolt 26. In this respect, the two connection plates 30 are welded to the base plate 28 such that the holes 32 formed in each connection plate 30 are linearly aligned to accept the connection bolt 26.

The base plate 28 further includes a hole 34 for insertion of a threaded stud 36 from the wall anchor 10 and is secured to the wall anchor 10 with a nut 38 threaded onto the stud 36. Specifically, the stud 36 protrudes through the hole 34 such that the nut 28 can be threadably engaged onto the stud 36. In this respect, the nut 28 is tightened on the threaded stud 36 to abut the base plate 28 in order to attach the end connector 24 the wall anchor 10.

Figure 2:
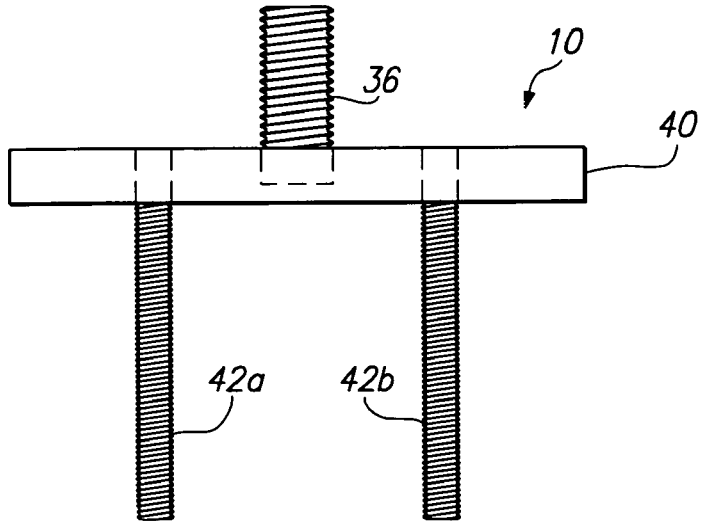
FIG. 2 is an elevational view of the wall anchor.
Figure 3:
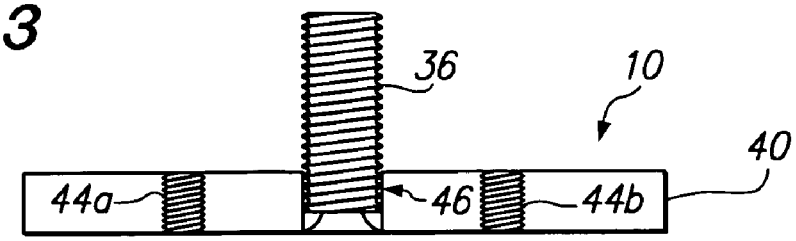
FIG. 3 is a cross-sectional view of the wall anchor.
Figure 4:
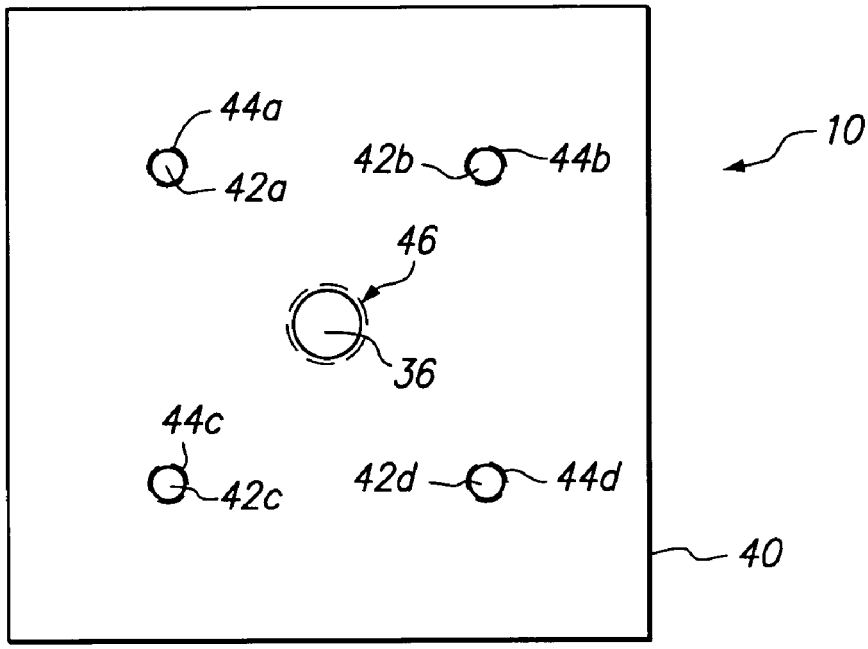
FIG. 4 is a plan view of the wall anchor.

The wall anchor 10 secures the end connector 24 and hence the flare strut system 12 to the concrete wall 14. Referring to FIGS. 2 through 4, the stud 36 is attached to an interface plate 40. The interface plate 40 is typically a rectangular section of ¾ inch thick steel. The size, thickness, and configuration of the interface plate 40 can vary depending upon the application. In the preferred embodiment, the shape of the interface plate 40 is an 8 inch by 8 inch square. It is also possible for the interface plate 40 to be octagonal, circular, hexagonal, etc. . . .

The threaded stud 36 is plug welded at the center of one side of the interface plate 40. In this respect, an aperture 46 is formed in the center of the interface plate 40 and the stud 36 is inserted into the aperture 46 and welded to the plate 40. In the preferred embodiment, the stud 36 is a 1 inch diameter× 2.5 inch long threaded rod made from steel.

Figure 5:
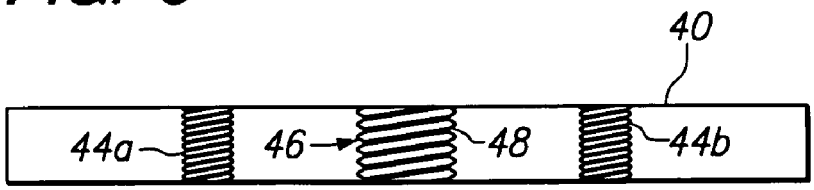
FIG. 5 is a cross-sectional view of the wall anchor with a threaded center stud hole.

Alternatively, the threaded stud 36 can be inserted into a threaded aperture 46 of the interface plate 40. Referring to FIG. 5, a cross-sectional view of the interface plate 40 is shown. The aperture 46 has threads 48 matching the threads of the stud 36. In this regard, the stud 36 is threadably engaged to the interface plate 40. The threads 48 of the aperture 46 can be formed in such a manner so as to prevent the stud 36 from being further turned after the stud 36 has been fully inserted (i.e., seated) in the threaded aperture 46 when the nut 38 is being tightened. It will be recognized by those of ordinary skill in the art, that by threadably engaging the stud 36 to the interface plate 40, it is possible to remove and exchange the stud 36 easily when needed. This may be advantageous during installation when a different length of stud 36 is needed.

In order to attach the interface plate 40 to the concrete wall 14, the wall anchor 10 has four legs 42*a*, 42*b*, 42*c* and 42*d* extending from a side of the interface plate 40 opposite the stud 36. In the preferred embodiment of the present invention, each of the legs is formed from ½ inch diameter threaded zinc-plated rod. In order to attach the legs 42 to the interface plate 40, four threaded holes 44*a*, 44*b*, 44*c*, and 44*d* are formed therein. Each of the threaded holes 44 is formed by drilling and tapping the interface plate 40 to a size to receive a respective one of the legs 42. In this respect, leg 42*a* is threadably attached to hole 44*a*, leg 42*b* is insertable into threaded hole 44*b*, etc . . . . The layout of the threaded holes 44 on the interface plate 40 is configured to equally spread the load between all four legs 42. The number and location of the legs 42 can vary depending upon the application and is chosen to balance the loading between the legs 42 and provide maximum anchor capacity while minimizing the structural requirements (i.e., thickness) of the interface plate 40. It will be recognized that by having more than one leg 42, the diameter of each leg 42 can be reduced thereby reducing the embedment depth of the leg 42 into the concrete wall 14. Therefore, the use of multiple legs 42 reduces the chances of brittle mode failure of the concrete wall 14.

Rods threaded into the interface plate 40 are used as the legs 42*a* in order to not interfere with the base plate 28 of the end connector 24. It is possible that the base plate 28 would be positioned over the legs 42 when the end connector 24 is attached to the wall anchor 10. Accordingly, nuts could not be used to secure the legs 42 to the interface plate 40 because the nuts would interfere with the base plate 28. It will be recognized that other types of attachment means for the legs 42 are possible such as welding the legs 42 so long as the attachment means does not interfere with the base plate 28. In the preferred embodiment of the invention, the threaded holes 44 are spaced to form a 4 inch by 4 inch square. The threaded rod forming the legs 42 can be cut to the desired length. In the preferred embodiment, the legs 42 are about 5.25 inches long so that after they are threaded into the interface plate 40, about 4.5 inches can be embedded within the concrete wall 14.

Referring back to FIG. 1, the wall anchor 10 is attached to the concrete wall 14 with the legs 42. In order to accept the legs 42, holes are formed in the concrete wall in a pattern that matches the pattern of the threaded holes 44 of the interface plate 40. Each hole formed in the concrete wall panel 14 is configured to receive a respective one of the legs 42. The diameter of the holes formed in the concrete panel 14 are slightly larger than the diameter of the threaded rod forming the leg 42. Typically, the diameter of the holes are formed about 1/16 inch to ⅛ inch larger than the diameter of the legs 42. Before the legs 42 are inserted into the holes formed in the concrete panel 14, an epoxy adhesive is injected into each hole. The gap between the leg 42 and the hole allows the epoxy to distribute around the threaded rod. The type of epoxy being used determines how much bigger the diameter of the holes formed in the concrete wall 14 should be. The threads on the legs 42 aid in the mechanical bond of the epoxy to the legs 42.

After the epoxy has been injected into the holes, the wall anchor 10 is pushed up against the concrete wall panel 14 such that the interface plate 40 abuts the concrete wall panel 14 as shown in FIG. 1. Once the epoxy has cured, the wall anchor 10 is secured to the concrete wall panel 14. The end connector 24 of the flare strut system 12 can be secured to the stud 36. In the preferred embodiment of the present invention, the capacity of the four legs 42 when bonded with the epoxy adhesives currently available is generally sufficient for most all flare strut system installations.

Additional modifications and improvements of the present invention may also be apparent to those of ordinary skill in the art. For example, the wall anchor 10 may be adapted to attach other types of brackets to the concrete wall panel. Thus, the particular combination of parts described and illustrated herein is intended to represent only certain embodiments of the present invention, and is not intended to serve as limitations of alternative devices within the spirit and scope of the invention.

What is claimed is:

1. A wall anchor, comprising:

an interface plate having a first planar side and a second planar side parallel thereto so as to have a uniform thickness, and wherein the second planar side is configured to abut a concrete wall, said interface plate having a first aperture that is threaded and formed therein at a first location proximate its center, and at least two second threaded apertures respectively formed therein at second locations on different sides of said first opening, said second threaded apertures having a constant diameter and extending from the first planar side to the second planar side;

an elongated stud directly and rigidly attached to the interface plate on the first planar side and formed of a uniform rod threaded along substantially the entire length thereof one end of the stud extending into a said first aperture a distance no greater than the thickness of said plate, and the other end of the stud being raised over the first planar side; and at least two legs directly attached to the interface plate on the second planar side and extending perpendicular thereto, each of the legs being configured to be insertable into a corresponding hole formed in the concrete wall and secured within the hole with an adhesive in order to attach the anchor to the concrete wall, each of the legs being fabricated from a uniform rod threaded along substantially the entire length thereof and having an end that is threaded into a corresponding one of said second threaded apertures and extends thereinto a distance no greater than the thickness of said plate;

said wall anchor being characterized in that said first planar side has but a single threaded stud projecting perpendicularly from its face and allows an apertured bracket to be securely anchored to multiple points on a concrete wall using a single nut;

wherein the wall anchor further comprises a bracket having a flat base for engaging said first planar side, and an aperture formed therein for receiving said stud, said bracket being engaged by the stud and secured to the interface plate with a nut threaded onto the stud.

2. The wall anchor of claim 1 wherein said interface plate has at least four of said second threaded apertures formed therein with each having a corresponding threaded leg attached thereinto.

3. The wall anchor of claim 2 wherein the legs are spaced in a generally rectangular pattern on the interface plate.

4. The wall anchor of claim 3 wherein each of the legs is evenly spaced on the interface plate.

5. The wall anchor of claim 1 wherein said bracket is an end connector for a flare strut.

* * * * *